US008710371B2

(12) United States Patent
Oka et al.

(10) Patent No.: US 8,710,371 B2
(45) Date of Patent: Apr. 29, 2014

(54) BEND RESISTANT CABLE

(75) Inventors: Fumihito Oka, Hitachi (JP); Hirotaka Eshima, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 197 days.

(21) Appl. No.: 13/010,131

(22) Filed: Jan. 20, 2011

(65) Prior Publication Data

US 2011/0220391 A1 Sep. 15, 2011

(30) Foreign Application Priority Data

Mar. 15, 2010 (JP) ..... 2010-057752

(51) Int. Cl.
*H01B 5/00* (2006.01)

(52) U.S. Cl.
USPC ..... 174/126.1

(58) Field of Classification Search
USPC ..... 174/28, 29, 36, 102 R, 106 R, 108
See application file for complete search history.

(56) References Cited

U.S. PATENT DOCUMENTS

| | | | | | |
|---|---|---|---|---|---|
| 1,393,750 | A | * | 10/1921 | Carter | 174/119 R |
| 2,037,506 | A | * | 4/1936 | Ensinger et al. | 57/6 |
| 2,972,658 | A | * | 2/1961 | Lapsley | 174/114 R |
| 3,475,893 | A | * | 11/1969 | Hiroyuki et al. | 57/58.84 |

FOREIGN PATENT DOCUMENTS

| | | | | | |
|---|---|---|---|---|---|
| JP | 51-111078 | U | | 9/1976 | |
| JP | 58-35218 | U | | 3/1983 | |
| JP | 61-167319 | U | | 10/1986 | |
| JP | 05-314832 | | * | 11/1993 | H01B 12/08 |
| JP | 08-148042 | | * | 6/1996 | H01B 11/04 |
| JP | 09-063367 | | * | 3/1997 | H01B 12/08 |
| JP | 2003-303517 | A | | 10/2003 | |
| JP | 2004-87436 | A | | 3/2004 | |
| JP | 2005-203117 | A | | 7/2005 | |
| JP | 2008-034341 | | | 2/2008 | |

OTHER PUBLICATIONS

Japanese Office Action, Sep. 17, 2013, 10 pages.

* cited by examiner

*Primary Examiner* — William H Mayo, III
(74) *Attorney, Agent, or Firm* — Foley & Lardner LLP

(57) ABSTRACT

A bend resistant cable includes a stranded wire including a plurality of child stranded conductors each having a plurality of strands, the plurality of child stranded conductors being circumferentially disposed and stranded. A stranding direction of the plurality of strands of the child stranded conductors circumferentially adjacent to each other is different from each other.

11 Claims, 3 Drawing Sheets

1 BEND RESISTANT CABLE
2 STRAND
3a,3b CHILD STRANDED CONDUCTOR
4 STRANDED WIRE
5 INSULATION LAYER
6 REINFORCING BRAIDED LAYER
7 JACKET
8 CENTER INCLUSION

BEND RESISTANT CABLE

The present application is based on Japanese patent application No. 2010-057752 filed on Mar. 15, 2010, the entire contents of which are incorporated herein by reference.

BACKGROUND OF THE INVENTION

1. Field of the Invention

This invention relates to a bend resistant cable, such as a cable for an electromechanical brake (EMB) of vehicles, robots, or an unsprung mass of vehicles etc, used in an environment requiring a bend resistance and a tensile strength. In particular, this invention relates to a bend resistant cable whose internal conductor structure is formed by stranding multiple child stranded conductors.

2. Description of the Related Art

In recent years, according as various automobile devices are electrified, various automobile cables such as EMB cables have been used. The automobile cables are used under a severe condition that requires characteristics such as a bend resistance and a tensile strength. For example, the EMB cables need to have a bend resistance and a tensile strength since they are frequently subject to vibration due to the operation (driving) of a suspension device.

As an automobile cable used in the environment requiring the bend resistance and the tensile strength, a bend resistant cable 40 as shown in FIG. 4 has been proposed.

The bend resistant cable 40 is constructed such that an insulation layer 43, a reinforcing braided layer 44, and a jacket 45 are sequentially formed on the periphery of a stranded wire 42 that is formed by stranding multiple child stranded conductors 41 each having multiple strands. The bend resistance and the tensile strength can be enhanced by the reinforcing braided layer 44 under the jacket 45.

In this cable with the child stranded conductors stranded, the child stranded conductors composing the stranded wire contact with each other. When it is bent, stress is applied to contact portions therebetween. Thus, the cable may be broken finally by receiving the stress repeatedly.

In order to solve the above problem, JP-A-2004-87436 discloses an aluminum cable for automobiles that a child stranded conductor at the center of a stranded wire has a smaller diameter than that of the other child stranded conductors, and JP-A-2003-303517 discloses an aluminum cable for automobiles that at least one of the child stranded conductors composing the stranded wire is coated with lubricant.

SUMMARY OF THE INVENTION

In the bend resistant cable having the reinforcing braided layer as mentioned above, fastening pressure from the reinforcing braided layer applies to the stranded wire. In addition, since the stranded wire is covered with the hard reinforcing braided layer, the child stranded conductors cannot have room to escape in bending. Thus, a strong contact pressure is applied to the contact portions between the child stranded conductors in bending, so that the contact portions may be worn when the child stranded conductors move to each other.

Therefore, even when the structures described in JP-A-2004-87436 and JP-A-2003-303517 are applied to the bend resistant cable 40, it is not possible to sufficiently satisfy the bend resistance required for the automobile cable, so that the cable may be disconnected under a severe condition.

It is an object of the invention to provide a bend resistant cable that has a sufficient bend resistance and tensile strength such that the abrasion between child stranded conductors can be reduced to the minimum.

(1) According to one embodiment of the invention, a bend resistant cable comprises:

a stranded wire comprising a plurality of child stranded conductors each having a plurality of strands, the plurality of child stranded conductors being circumferentially disposed and stranded, wherein a stranding direction of the plurality of strands of the child stranded conductors circumferentially adjacent to each other is different from each other.

In the above embodiment (1) of the invention, the following modifications and changes can be made.

(i) The stranded wire further comprises a central inclusion on a periphery of which the plurality of child stranded conductors are disposed.

(ii) The stranded wire is formed by disposing the plurality of child stranded conductors on a periphery of a dummy wire and stranding them, and the dummy wire is then removed.

(iii) The stranded wire further comprises a central inclusion at a center thereof.

(iv) The stranded wire further comprises a hollow at a center thereof.

(v) The bend resistant cable further comprises:

an insulation layer; a reinforcing braided layer; and a jacket that are sequentially formed on a periphery of the stranded wire.

(vi) A stranding pitch of strands of the child stranded conductors adjacent to each other is equal to each other.

(vii) Strands of the child stranded conductors adjacent to each other are substantially in parallel contact with each other along a longitudinal direction of the cable.

Points of the Invention

According to one embodiment of the invention, a bend resistant cable is constructed such that a stranded wire is formed by alternately arranging and stranding child stranded conductors and child stranded conductors that the stranding direction of the strands thereof is different from each other, so that the strands on the surface of the child stranded conductors and the child stranded conductors adjacent to each other can be in parallel contact with each other along the longitudinal direction of the cable, i.e., they can have line-contact (or linear contact) with each other such that the contact surface pressure can lower significantly as compared to the conventional bend resistant cable, and the stress applied in bending can be reduced. Thus, the bend resistance can be significantly enhanced.

BRIEF DESCRIPTION OF THE DRAWINGS

The preferred embodiments according to the invention will be explained below referring to the drawings, wherein.

DETAILED DESCRIPTION OF THE PREFERRED EMBODIMENTS

Figure 1:
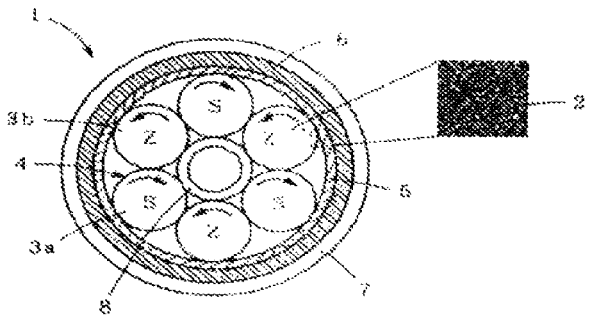
FIG. 1 is a transverse cross-sectional view schematically showing a bend resistant cable in one embodiment of the invention.

The preferred embodiments according to the invention will be explained below referring to the drawings.

Figure 4:
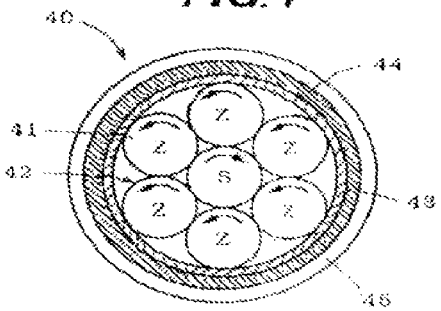
PRIOR ART FIG. 4
FIG. 4 is a transverse cross-sectional view schematically showing a conventional bend resistant cable.

First, a mechanism of breaking of wires in the conventional bend resistant cable 40 shown in FIG. 4 will be explained.

Figure 5:
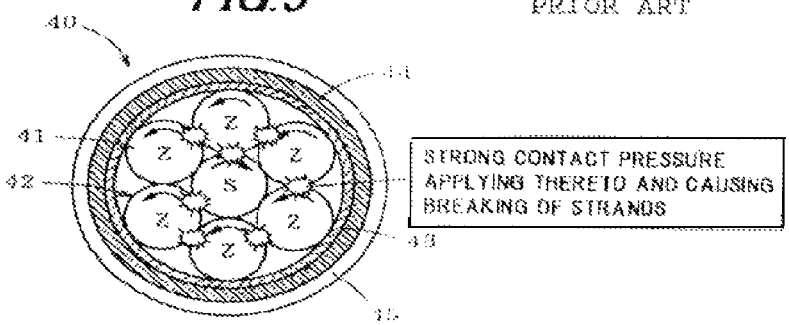
FIG. 5 PRIOR ART
FIG. 5 is an explanatory view schematically showing a mechanism of breaking of wires in the bend resistant cable shown in FIG. 4.

As shown in FIG. 5, the conventional bend resistant cable 40 is constructed such that a stranded wire 42 is formed by using mainly child stranded conductors 41 that have the same stranding direction of the strands each other. Thus, the strands on the surface of the adjacent child stranded conductors 41 contact with each other in the crossing direction. Since a point contact can be made at the crossing portions, i.e., the contact area decreases, the contact pressure at the contact portion increases so that in bending, stronger stress may be applied thereto to disconnect the cable.

The bend resistant cable 40 is constructed such that, in order to prevent the workability of the cable from lowering by the distortion of the cable, the child stranded conductor 41 at the center is S-stranded and the other child stranded conductors 41 on the periphery thereof are Z-stranded (different from being S-stranded) so as to prevent the cable from being distorted.

In the stranded wire 42 with the above construction, the center child stranded conductor 41 and the other child stranded conductors 41 disposed on the periphery of the center child stranded conductor 41 have the stranding direction of wires different from each other, so that the strands on the surface thereof can have line-contact (or linear contact) with each other in a direction close to parallel. In addition, the stranding pitch (longitudinal length needed for 360 degrees rotation of the strand) of the center child stranded conductor 41 and the other child stranded conductors 41 disposed on the periphery of the center child stranded conductor 41, and the stranding pitch of the stranded wire 42 are equal to each other, so that the strands on the surface thereof can have line-contact (linear contact) with each other substantially in the parallel direction. Consequently, the contact area therebetween increases and the stress concentration due to the bending can lower.

However, the center child stranded conductor 41 is less deformed (for example, bent and deformed) due to the stranding in comparison with the other child stranded conductors 41 disposed on the periphery, so that in the bending, the strands on the surface thereof are not necessarily into line-contact with each other in the parallel direction, and in bending, the strong stress applies to the parts which may cause the breaking of strands (refer to FIG. 5).

The inventors considered the above mechanism of breaking of strands and devised the conductor construction that the strands of the child stranded conductors adjacent to each other are substantially in parallel contact with each other along the longitudinal direction of the cable.

Figure 2:
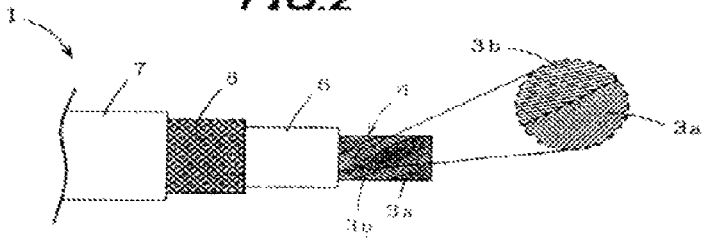
FIG. 2 is a side view schematically showing a conductor structure used in the bend resistant cable in one embodiment of the invention.

FIG. 1 is a transverse cross-sectional view schematically showing a bend resistant cable according to one embodiment of the invention, and FIG. 2 is a side view schematically showing a conductor structure used in the embodiment.

As shown in FIG. 1 and FIG. 2, a bend resistant cable 1 according to the embodiment is characterized in that a stranded wire 4 is formed by arranging circumferentially and stranding plural child stranded conductors (with a stranding direction of S) 3*a* and plural child stranded conductors (with a stranding direction of Z) 3*b* each having plural strands 2 stranded, and that the stranding direction of the strands of the child stranded conductors 3*a* and the child stranded conductors 3*b* adjacent to each other in the circumferential direction are different from each other.

The reason why the stranded wire 4 is formed by further stranding the plural child stranded conductors 3*a* and the plural child stranded conductors 3*b* each having the plural strands 2 stranded is because the bend resistance of the cable can be enhanced.

The stranded wire 4 is formed by alternately disposing the plural child stranded conductors 3*a* and the plural child stranded conductors 3*b* that the stranding direction of the strands is different from each other on the periphery of a central inclusion 8 and stranding them. Namely, in this case, the stranded wire 4 has the central inclusion 8 at the center thereof. In addition, the bend resistant cable 1 of the embodiment is constructed such that an insulation layer 5, a reinforcing braided layer 6 and a jacket 7 are sequentially formed on the periphery of the stranded wire 4 in the order. However, the invention is not limited to this construction, and the construction can be appropriately changed in accordance with characteristics required for the bend resistant cable.

The central inclusion 8 is formed of, for example, a silicone tube, a resin string, and is arranged so as to allow the child stranded conductors 3*a* and the child stranded conductors 3*b* stranded on the periphery thereof to escape in bending and to reduce stress. In addition, the central inclusion 8 has a function as a core material used for stranding the child stranded conductors 3*a* and the child stranded conductors 3*b* into a circular shape (in its cross sectional view).

Further, it is preferable that the child stranded conductors 3*a* and the child stranded conductors 3*b* adjacent to each other have an equal stranding pitch of the strands thereof. Due to this, the strands on the surface of the child stranded conductors 3*a* and the child stranded conductors 3*b* can parallel contact with each other.

The child stranded conductors 3*a* or the child stranded conductors 3*b* are not used as a core material. The reason comes from the following.

When the child stranded conductors 3*a* (or 3*b*) are used as the core material, the center child stranded conductor 3*a* (or 3*b*) as the core material and the other child stranded conductors 3*b* (or 3*a*) on the periphery thereof can have the stranding direction of strands different from each other, so that the strands on the surface thereof can contact (in line contact) with each other substantially in a parallel direction. In addition, the center child stranded conductor 3*a* (or 3*b*) as the core material and the other child stranded conductors 3*b* (or 3*a*) on the periphery thereof can have the stranding pitch equal to each other, so that the strands on the surface thereof can contact (in line contact) with each other substantially in a parallel direction. Thus, the contact area therebetween can increase so as to reduce a stress concentration caused by the bending.

However, although the child stranded conductors 3*a* and 3*b* on the periphery have the stranding direction of strands different from each other, the strands of the child stranded conductors 3*a* (3*b*) on the periphery and the strands of the child stranded conductors 3*a* (3*b*) as the core material can have the stranding direction of strands equal to each other. In this case, they cannot contact (in line contact) with each other substantially in a parallel direction. As a result, the strands of the child stranded conductors 3*a* (3*b*) on the periphery and the strands of the child stranded conductors 3*a* (3*b*) as the core material having the same stranding direction of strands must make a point contact with each other, and breaking of wires originates therein, so that the child stranded conductors are not be used as the core material.

As a fibrous material constituting the reinforcing braided layer 6, in view of bending fatigue of the cable, it is preferred to use a material that has excellent fatigue resistance and abrasion resistance. The reinforcing braided layer 6 is used as a layer that enhances a grip force, a layout retention property and tensile strength. In addition, as a constituent material of the jacket 7, it is preferred to use a material that has good heat resistance, weather resistance and oil resistance.

In the bend resistant cable 1, the reinforcing braided layer 6 is disposed under the jacket 7, so that tensile strength can be enhanced.

In addition, the stranded wire 4 is formed by alternately arranging on the periphery of the central inclusion 8 and stranding the child stranded conductors 3*a* and the child stranded conductors 3*b* that the stranding direction of the strands is different from each other, so that the strands on the surface of the child stranded conductors 3*a* and the child stranded conductors 3*b* adjacent to each other can be substantially in parallel contact with each other along the longitudinal direction of the cable, i.e., they can have line-contact (or linear contact) with each other such that the contact surface pressure can lower significantly as compared to the conventional bend resistant cable 40, and the stress applied in bending can be reduced. Thus, the bend resistance can be significantly enhanced. For example, the conventional bend resistant cable 40 has been subject to breaking of strands at about hundred thousand times in the bending test, but the bend resistant cable 1 can attain a bending life of about several hundred thousand times to million times.

As described above, in short, in accordance with the bend resistant cable 1 according to the embodiment, a bend resistant cable that is capable of keeping abrasions among the child stranded conductors 3*a* and the child stranded conductors 3*b* to a minimum and has high bend resistance and tensile strength can be provided.

Figure 3:
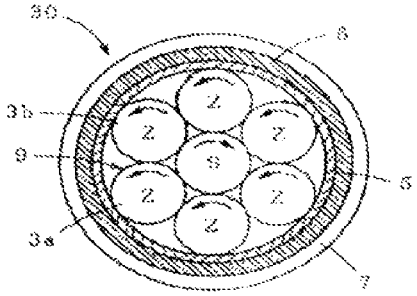
FIG. 3 is a transverse cross-sectional view schematically showing a bend resistant cable in another embodiment of the invention.

In the embodiment, the stranded wire 4 is formed by parallel arranging on the periphery of the central inclusion 8 and stranding the child stranded conductors 3*a* and the child stranded conductors 3*b*, but not specifically limited to this. As shown in FIG. 3, the stranded wire 4 can have a hollow at the center thereof. In forming the above structure, for example, after the plural child stranded conductors 3*a* and the plural child stranded conductors 3*b* are arranged on the periphery of a dummy wire and stranded, the dummy wire is removed so as to form a stranded wire 9. A bend resistant cable 30 using the stranded wire 9 is also capable of keeping abrasions between the child stranded conductors 3*a* and the child stranded conductors 3*b* to the minimum and has sufficient bend resistance and tensile strength similarly to the bend resistant cable 1.

In addition, the bend resistant cable 30 having the hollow at the center of the stranded wire 9 may be formed by sequentially disposing the insulation layer 5, the reinforcing braided layer 6 and the jacket 7 on the periphery of the stranded wire, but the invention is not specifically limited to this construction. The construction thereof can be suitably changed in accordance with characteristics required for the bend resistant cable.

In addition, the bend resistant cable 30 having the hollow at the center of the stranded wire 9 may be constructed such that the stranding pitch of the strands of the child stranded conductors 3*a* and the child stranded conductors 3*b* adjacent to each other is equal to each other. Due to this, the strands 2 on the surface of the child stranded conductors 3*a* and the child stranded conductors 3*h* can have linear contact with each other in the parallel direction.

Meanwhile, a shield cable may be formed by disposing a shield layer on the bend resistant cables 1, 30. In this case, the shield layer is formed by serving conductors to obtain a shield layer excellent in bend resistance.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A bend resistant cable, comprising:

a stranded wire comprising a hollow at a center thereof and a plurality of child stranded conductors each having a plurality of strands, the plurality of child stranded conductors being circumferentially disposed and stranded, the plurality of child stranded conductors being disposed on a periphery of the hollow at the center;

wherein a stranding direction of the plurality of strands of each of the child stranded conductors circumferentially adjacent to each other is different.

2. The bend resistant cable according to claim 1, wherein the stranded wire is formed by disposing the plurality of child stranded conductors on a periphery of a dummy wire and stranding them, and then removing the dummy wire.

3. The bend resistant cable according to claim 1, further comprising: an insulation layer; a reinforcing braided layer; and a jacket that are sequentially formed on a periphery of the stranded wire.

4. The bend resistant cable according to claim 1, wherein a stranding pitch of strands of the child stranded conductors adjacent to each other are equal to each other.

5. The bend resistant cable according to claim 1, wherein strands of the child stranded conductors adjacent to each other are substantially in parallel contact with each other along a longitudinal direction of the cable.

6. The bend resistant cable according to claim 1, wherein the bend resistant cable is configured to be disposed as part of a vehicle.

7. The bend resistant cable according to claim 1, wherein an electromechanical brake (EMB) in a vehicle includes the bend resistant cable.

8. The bend resistant cable according to claim 1, wherein the bend resistant cable has a bending life of about several hundred thousand times to million times.

9. The bend resistant cable according to claim 1, wherein the bend resistant cable is configured to be used in an environment requiring a bend resistance, and the required bend resistance is such that a contact surface pressure on the bend resistant cable can be lowered in the environment.

10. The bend resistant cable according to claim 1, wherein the plurality of child stranded conductors are disposed to define the hollow along a longitudinal direction of the cable.

11. A bend resistant cable, comprising:

a stranded wire comprising a hollow at a center thereof and a plurality of child stranded conductors each having a plurality of strands, the plurality of child stranded conductors being circumferentially disposed and stranded, the plurality of child stranded conductors being disposed on a periphery of the hollow at the center;

wherein a stranding direction of the plurality of strands of each of the child stranded conductors circumferentially adjacent to each other is different, wherein the stranded wire is formed by disposing the plurality of child stranded conductors on a periphery of a dummy wire and stranding them, and then removing the dummy wire.

* * * * *